US007772473B2

(12) United States Patent
Shepherd

(10) Patent No.: US 7,772,473 B2
(45) Date of Patent: Aug. 10, 2010

(54) RIM RISER

(76) Inventor: James F. Shepherd, 51-27 63St., Woodside, NY (US) 11377

( * ) Notice: Subject to any disclaimer, the term of this patent is extended or adjusted under 35 U.S.C. 154(b) by 186 days.

(21) Appl. No.: 11/055,250

(22) Filed: May 16, 2005

(65) Prior Publication Data

US 2005/0188815 A1 Sep. 1, 2005

Related U.S. Application Data

(60) Provisional application No. 60/544,830, filed on Feb. 17, 2004.

(51) Int. Cl.
*G10D 13/02* (2006.01)

(52) U.S. Cl. ..... 84/411 R; 84/453

(58) Field of Classification Search ..... 84/411 R, 84/411 P, 453, 465
See application file for complete search history.

(56) References Cited

U.S. PATENT DOCUMENTS 3,818,791 A * 6/1974 Zickos ..... 84/411 R
4,283,985 A * 8/1981 Famularo ..... 84/411 R
4,344,349 A * 8/1982 Cordes ..... 84/411 R
RE33,685 E * 9/1991 Andre et al. ..... 84/413
5,261,309 A * 11/1993 Valen ..... 84/453
6,921,857 B2 * 7/2005 Yoshino et al. ..... 84/738
2003/0000366 A1 * 1/2003 Miller ..... 84/411 R

* cited by examiner

*Primary Examiner*—Jianchun Qin
(74) *Attorney, Agent, or Firm*—Michael D. Eisenberg

(57) ABSTRACT

The claimed device is a drum rim extension. Previously, drummers playing cross-stick, (that is, laying the stick across the rim of the drum to produce a clicking or tapping sound), had difficulty maintaining a good grip on the drumstick and finding a consistent sound throughout performances. The drum rim extension is a block of metal, wood or plastic that connects to a portion of the rim of and drum and provides the player up to several inches of free space above the drum, improving stick handling and playing consistency. The drum rim extension improves drumming where rim playing is prominent in musical pieces.

16 Claims, 2 Drawing Sheets

RIM RISER

CROSS-REFERENCES TO RELATED APPLICATIONS

Application No. 60/544,830, filing date Feb. 17, 2004.

TECHNICAL FIELD

The present invention relates to a drum rim rising device and some embodiments relate to a drum having a raised arc section of a drum rim.

BACKGROUND OF THE INVENTION

This invention relates to the need for accurate and consistent cross-stick playing, and, also addresses limitations in controlled acoustical sounds related to rim playing. This is due in part to the impossibility of a good grip on the drumstick. More particularly, it concerns an easily attachable, rim raising device that allows for a controlled accurate swing due to the allowance of a firmer grip on the drumstick.

Different drums have different acoustical properties, thus dramatically changing the cross stick sound, also, drum rims are very close to the playable drum head. The action of the drummer playing the head of the drum and switching to a cross stick sound requires a considerable amount of effort with very limited control.

BRIEF SUMMARY OF EMBODIMENTS OF THE INVENTION

It is the object of the invention to provide a solution to the problems described above. As will be seen, this device can be used in such a manner, as to further articulate cross stick playing, as well as enhance other areas of rim playing. With increased agility available to the player it opens up new acoustical possibilities.

A rim raising device is attachable to a drum, and includes,

A) A section of hard steel or hard synthetic material, solid or hallowed out, following the primary curvature of the arcuate rim, above the drum.

B) A mounting system, in which the presented device, fits onto the existing tension rods of a drum, and, is equipped with screws that tighten into threaded spacers. The device is held securely in place through its own torque.

As will be shown, another object is to provide the device as a molded configuration, with a section of the hoop sloping upward flattening out then descending, providing added cross stick playing space.

DETAILED DESCRIPTION OF THE EMBODIMENTS OF THE INVENTION

Figure 1:
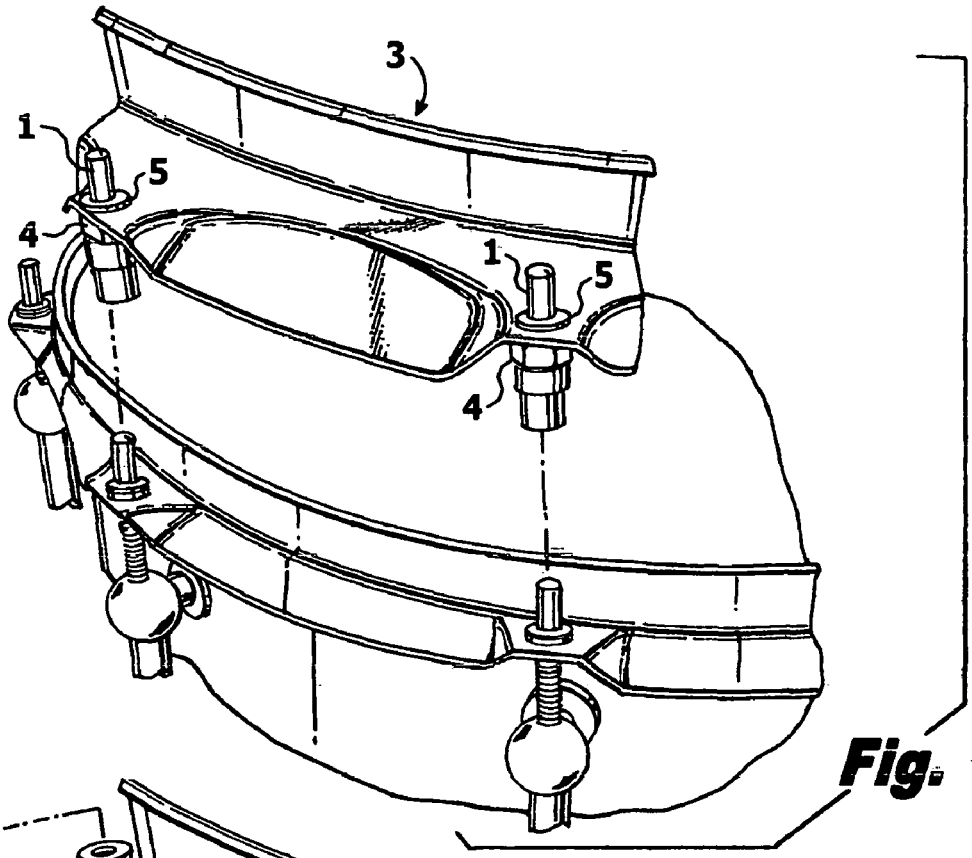
FIG. 1 is a fragmented view of a drum and one embodiment of the Rim Raising device.

Referring to FIG. 1, the rim raising device is primarily comprised of hard steel, wood or a hardened synthetic material with curvature in the arcuate direction above the drum 3 the attachment system is of a threaded material fitting onto the existing tuning rods of a drum 4 with tightening screws 1 and locking washers 5 device is secured through its own torque onto the drum.

Figure 2:
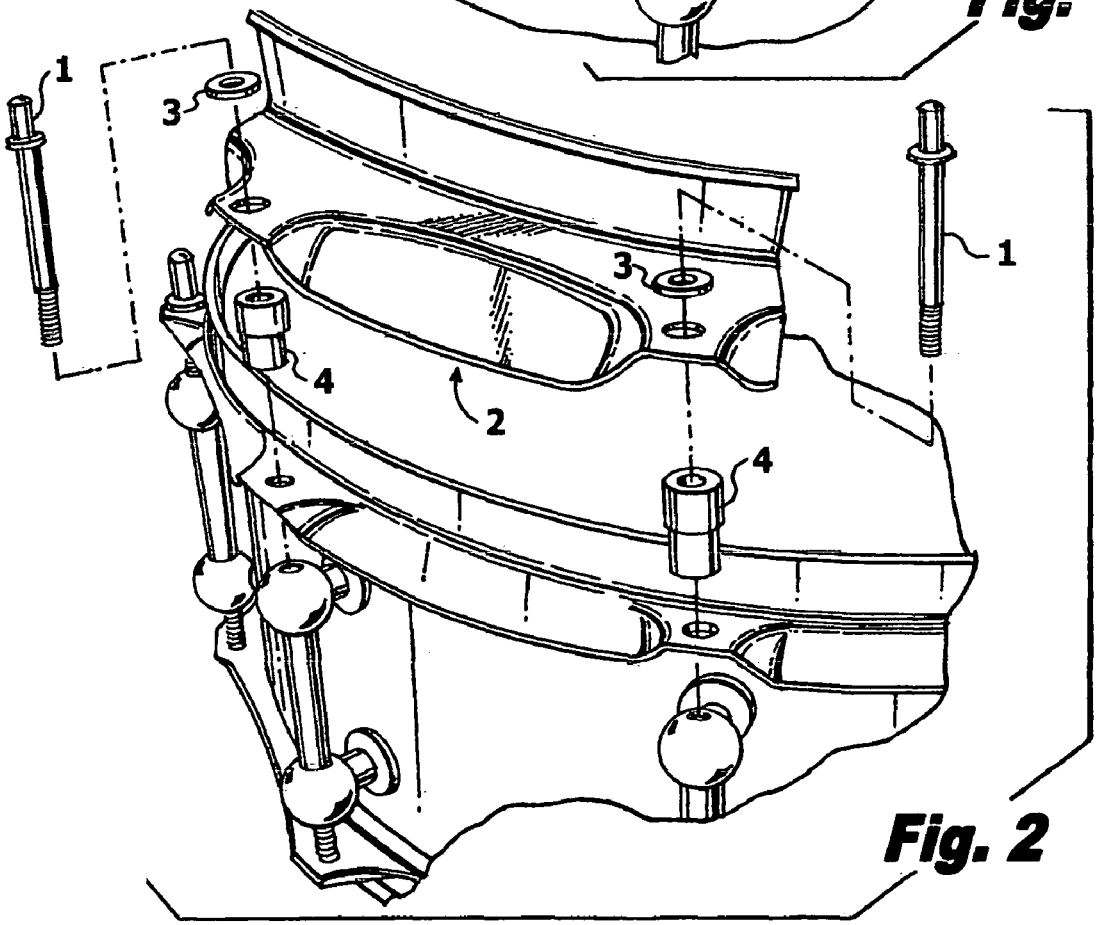
FIG. 2 is a perspective view of the drum of FIG. 1 of a different embodiment of the invention.

Referring to FIG. 2, the rim raising device comprised of the same materials as in FIG. 2 attaches by way of spacers 4 device is flanged to align with the existing flanges on the drum's rim and extended tension rods 1 hold the device securely. Washers are added to ensure stability 3.

Figure 3:
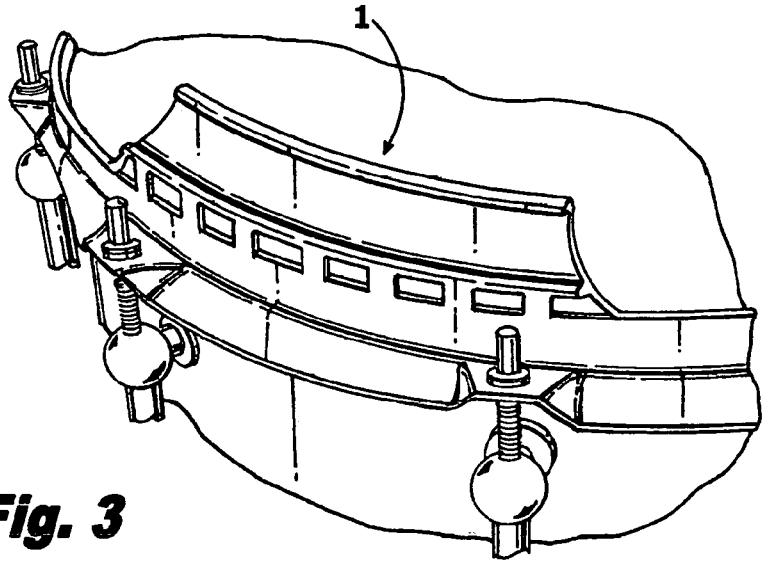
FIG. 3 is a pre-molded embodiment as part of the existing drum rim.

FIG. 3 illustrates a pre-molded configuration 1. The rim raising device is one complete unit with drum's rim.

Figure 4:
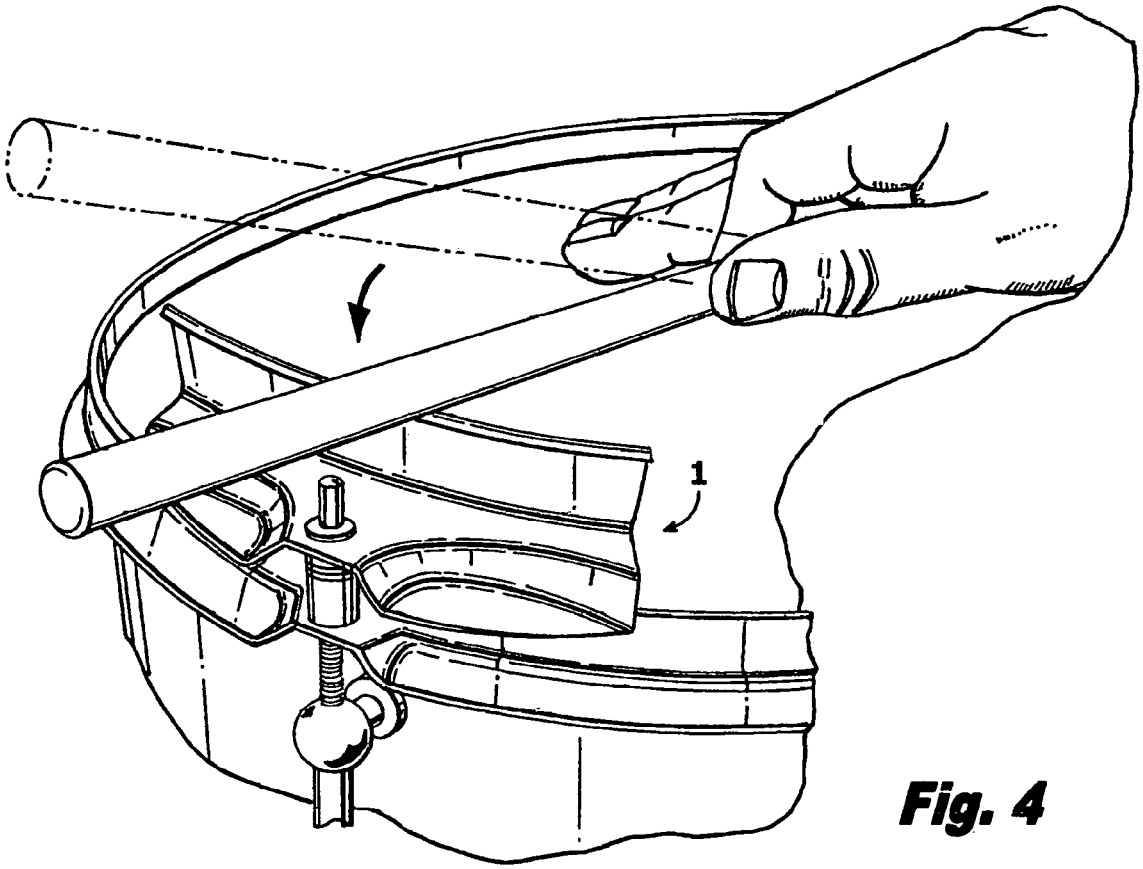
FIG. 4 illustrations one aspect in which an embodiment of the invention is applied (fitted for a singular tension rod).

Referring to FIG. 4, the Rim Raising device comprised of the same materials and would typically be a length of two to nine inches in length. As previously mentioned may also attach to a singular extended tension rod 1 and one spacer. The device is flanged to align with existing flange on the drum's rim. This illustration also demonstrates one advantageous way the invention works. The user is given more space between the drum's rim and the playable drum head for added agility.

The invention claimed is:

1. A drum rim raising device that is attachable to an existing drum structure, comprising:

an arc section of a drum rim configured to be secured to the existing drum housing;

wherein the arc section of a drum rim comprises a side wall and a top edge, the side wall configured to elevate the top edge over the drum rim circumference of an existing drum rim and is disposed between the drum rim circumference and the top edge when the drum rim raising device is attached to the existing drum structure;

wherein the top edge of the arc section is spaced apart vertically above the existing rim structure when the drum rim raising device is attached to the existing drum structure; and wherein the drum rim raising device is flanged to align with the flanges on the existing drum rim;

wherein the drum rim raising device is configured to replace the corresponding arc section of the existing drum rim such that when the drum rim raising device is attached to the existing drum rim, the drum and rim raising device comprise an assembly for allowing a drummer to can maintain a more comfortable and natural grip on a drum stick when cross-sticking is performed on the drum rim.

2. The drum rim raising device of claim 1 comprised of a hardened synthetic material.

3. The drum rim raising device of claim 1 comprised of hardened steel and is attached by a clamp or clamps.

4. The drum rim raising device of claim 1, further comprising a threaded spacer for attaching the device and tightening it onto drum's existing tension rods.

5. The drum rim raising device of claim 1 replacing the existing tension rods on the drum.

6. The drum rim raising device of claim 1 wherein the rim raising device is comprised of a solid wood block that is connected to the drum via at least one clamp.

7. The drum rim raising device of claim 1 wherein the rim raising device is comprised of a durable plastic piece that is screwed into at least one existing tension rod of the drum.

8. The drum rim raising device claim 1 wherein the rim raising device is comprised of a durable plastic piece that is connected to the drum with at least one extended tension rod.

9. The drum rim raising device claim 1 wherein the arc section of a drum rim is configured to form an air space between the arc section and the existing drum rim when the arc section is attached to the existing drum rim.

10. The drum rim raising device of claim 1, wherein the rim raising device comprises 95% or less of the circumference of the existing drum rim.

11. The drum rim raising device of claim 1, further comprising air spaces disposed within the rim raising device.

12. The drum rim raising device of claim 1, wherein the drum rim raising device is configured for attachment to an existing drum rim such that a bottom edge of the drum rim raising device is spaced apart from and above the drum rim.

13. A drum rim raising device that is attachable to an existing drum structure, comprising:

an existing drum rim having a conventional height extending from a drum head;

an arc section of a drum rim configured to be secured to the existing drum housing;

wherein the arc section of a drum rim comprises a side wall and a top edge, the side wall configured to elevate the top edge directly above an existing drum rim a distance greater than or equal to the height of the drum rim itself; and wherein the drum rim raising device is flanged to align with the flanges on the existing drum rim;

wherein the drum rim raising device is configured to replace the corresponding arc section of the existing drum rim such that when the drum rim raising device is attached to the existing drum rim, the drum rim raising allows a drummer to maintain a more comfortable and natural grip on a drum stick when used on the drum rim raising device for cross-sticking.

14. The drum rim raising device of claim 13, wherein the arc section has a curvature that matches the existing drum rim.

15. The drum rim raising device of claim 13, wherein the arc section is configured to be disposed somewhere in a volume bounded by an area projected upward 90 degrees from the outer perimeter of the drum.

16. The drum rim raising device of claim 13, wherein the drum rim raising device is configured for attachment to an existing drum rim such that a bottom edge of the drum rim raising device is spaced apart from and above the drum rim.

* * * * *